US006616590B2

(12) United States Patent
Kessler et al.

(10) Patent No.: US 6,616,590 B2
(45) Date of Patent: Sep. 9, 2003

(54) LOW-SHEAR FEEDING SYSTEM FOR USE WITH CENTRIFUGES

(75) Inventors: Stephen B. Kessler, Princeton, MA (US); Robert B. Carr, Brookline, MA (US); Gary W. Brown, Sr., Framingham, MA (US)

(73) Assignee: Kendro Laboratory Products, LP, Newtown, CT (US)

( * ) Notice: Subject to any disclaimer, the term of this patent is extended or adjusted under 35 U.S.C. 154(b) by 0 days.

(21) Appl. No.: 09/860,666

(22) Filed: May 18, 2001

(65) Prior Publication Data

US 2002/0082154 A1 Jun. 27, 2002

(Under 37 CFR 1.47)

Related U.S. Application Data

(60) Provisional application No. 60/205,955, filed on May 19, 2000.

(51) Int. Cl.[7] ..... B04B 9/12; B04B 11/06

(52) U.S. Cl. ..... 494/65; 494/67

(58) Field of Search ..... 494/5, 6, 60, 62, 494/65, 67; 210/377

(56) References Cited

U.S. PATENT DOCUMENTS

| | | | | |
|---|---|---|---|---|
| 1,048,905 A | * | 12/1912 | Sperry | |
| 2,083,809 A | | 6/1937 | Asch | |
| 2,593,294 A | | 4/1952 | Goldberg | |
| 2,785,765 A | * | 3/1957 | Cornell | |
| 3,023,949 A | | 3/1962 | Bankerd | |
| 3,327,401 A | | 6/1967 | Stamos et al. | |
| 3,989,185 A | | 11/1976 | Mercier | |
| 5,328,441 A | | 7/1994 | Carr | |
| 5,356,367 A | | 10/1994 | Carr | |
| 5,674,174 A | | 10/1997 | Carr | 494/67 |
| 5,733,238 A | | 3/1998 | Carr | |
| 5,743,840 A | | 4/1998 | Carr | |
| 5,823,937 A | | 10/1998 | Carr | 494/67 |

FOREIGN PATENT DOCUMENTS

| | | | |
|---|---|---|---|
| GB | 2155366 | * | 9/1985 |

* cited by examiner

*Primary Examiner*—Charles E. Cooley
(74) *Attorney, Agent, or Firm*—Baker & Hostetler LLP

(57) ABSTRACT

There is provided a centrifugal separator for solid-liquid separations. The centrifugal separator comprises (a) an accelerator rotatable at an angular velocity, ω about an axis, and having an inside surface with a point on the axis, and (b) a nozzle for introducing a feed stream at a volumetric flow rate (Q) into the accelerator via an orifice. The orifice is substantially centered about the point, and the orifice has an inner diameter (d) within the range of approximately $$0<d\leqq 4\delta,$$

where $\delta=1.414\ [(4Q/\pi^2\omega)^{1/3}]$.

8 Claims, 6 Drawing Sheets

LOW-SHEAR FEEDING SYSTEM FOR USE WITH CENTRIFUGES

CROSS REFERENCE TO RELATED APPLICATIONS

The present application is claiming priority of U.S. Provisional Patent Application Serial No. 60/205,955, filed on May 19, 2000.

BACKGROUND OF THE INVENTION

1. Field of the Invention

The present invention relates to centrifuges, and more particularly, to a centrifugal separator for solid liquid separation having a low-shear feeding system.

2. Description of the Prior Art

In a continuous flow centrifugal separator, a solid-liquid suspension in a feed stream is introduced into a rotating bowl. Various feeding systems have been employed to accelerate the velocity of the feed stream to the angular velocity of the bowl. Some prior art feeding systems were designed without consideration of the sensitivity of the solid particles in the feed to shear stresses. When a separator that incorporates such a feeding system is used to separate a solid from a solid-liquid suspension, the solid particles are typically subjected to high levels of shear stress. If the suspended particles are shear-sensitive, as in the case of precipitated proteins or living cells, the particles may be broken or otherwise damaged.

U.S. Pat. No. 5,674,174, issued to Carr (hereinafter "the '174 patent"), describes a feeding system that is intended to minimize shear stresses. The '174 patent describes applying a feed stream to a rotating distributor cone by an applicator head in such a way that the velocity of the feed stream exiting the applicator head attempts to match the velocity of an adjacent rotating conical surface. However, in practice, as the feed stream contacts the rotating conical surface, it is subjected to a multi-dimensional velocity profile. There is a longitudinal component, e.g., a component parallel to the surface and normal to the direction of rotation, and one or more tangential components, i.e., components in the direction of rotation. In the '174 patent, the applicator head imparts only a tangential velocity on the feed stream, and in many cases, shear stresses due to the longitudinal velocity component exceed those due to the tangential velocity component. Consequently, the applicator head of the '174 patent does not produce sufficiently low shear stresses for use with mammalian cells. Also, in the system of the '174 patent, the point on the rotating distributor cone at which the feed stream is applied is at a significant radial distance from the axis of rotation of the distributor cone, and as such, typical surface velocities are also significant. For example, if a feed stream is applied at a radius of 5 cm and the distributor cone is rotating at 10,000 rpm, the surface velocity that must be matched by the feed stream is approximately 5236 cm/sec. Imparting such a high velocity to the feed stream subjects the feed stream to a high level of shear stress in conduits leading to the applicator head. Additionally, a small mismatch in velocities between the feed stream from the applicator head and the spinning surface of the distributor cone, resulting either from the directional difference mentioned above, i.e., longitudinal versus tangential components, or from flow rate control tolerances, produces substantial shear stresses. Consequently, the system described in the '174 patent appears to be best suited for suspended solids that are only moderately sensitive to shear, such as yeast cells or compact precipitates, but it is not suitable for more shear-sensitive materials, such as mammalian cells.

Another system that addresses the shear stress problem is disclosed in U.S. Pat. No. 5,823,937, issued to Carr (hereinafter "the '937 patent"). While the '937 patent generally teaches placing a feed applicator off-center to an axis of rotation of a centrifuge bowl, it also describes a feed applicator that applies a feed stream concentric with the axis of rotation. The concentric approach, as compared to that of the '174 patent, may reduce the radius from the axis of rotation at which the feed stream contacts the rotating surface and therefore potentially reduce shear stress. However, tests have revealed that concentric application of the feed stream, alone, does not guarantee that shear-sensitive materials are preserved.

Consequently, there is a need for a separator that is capable of processing the most shear-sensitive cells and precipitates. The present invention overcomes the problems associated with the conventional separator devices by providing a separator that is capable of processing ultra shear-sensitive cells and precipitates.

SUMMARY OF THE INVENTION

A centrifugal separator comprising (a) an accelerator rotatable at an angular velocity, $\omega$ about an axis, and having an inside surface with a point on the axis, and (b) a nozzle for introducing a feed stream at a volumetric flow rate, Q into the accelerator via an orifice. The orifice is substantially centered about the point, and the orifice has an inner diameter, d within the range of approximately $$0<d\leq 4\delta,$$

where $\delta=1.414[(4Q/\pi^2\omega)^{1/3}]$.

DESCRIPTION OF THE INVENTION

The present invention provides for a centrifugal separator for solid-liquid separation of ultra shear-sensitive material, such as, mammalian cells. In addition to mammalian cells, materials, such as, precipitated proteins, are extremely sensitive to, and may be damaged by, shear stress. The particles of precipitated protein can break down under shear to form smaller particles that are more difficult to separate. The present invention is suitable for use with such materials.

The present invention enables a significant reduction in shear stress in a centrifuge feed zone as compared with prior art designs. This is accomplished by delivering a feed stream as a narrow jet through a nozzle orifice, where the feed stream is applied along an axis of rotation of a dome-shaped feed accelerator. The nozzle orifice is spaced apart from the dome-shaped feed accelerator by an adjustable gap. An average feed stream velocity through the orifice matches a tangential surface velocity on the dome-shaped feed accelerator averaged over an area on the accelerator upon which the feed stream is discharged. By sizing the orifice such that the average velocity of the feed stream flowing from the orifice matches the tangential velocity of the accelerator surface, shear forces on solid constituents within the feed stream are minimized.

Making the orifice an arbitrary size without considering other parameters can aggravate the situation with respect to the shear forces. For example, if the orifice size is reduced while keeping the centrifuge speed and flow rate the same, then the feed stream will impinge on a smaller diameter target on the accelerator and experience reduced shear rates due to the tangential motion of the accelerator. However, the feed stream will now be moving faster in the nozzle and will experience higher shear rates both within the nozzle and upon impingement of the jet on the surface of the accelerator.

Conversely, if the orifice size is increased, then the feed stream will experience lower shear rates in the nozzle and upon impingement of the jet on the surface of the accelerator. However, because the radius of the area onto which the feed stream is discharged is greater, the larger target area will subject the feed stream to higher shear rates due to the higher tangential velocities at the points of impingement that are further from the axis of rotation of the accelerator.

Figure 1:
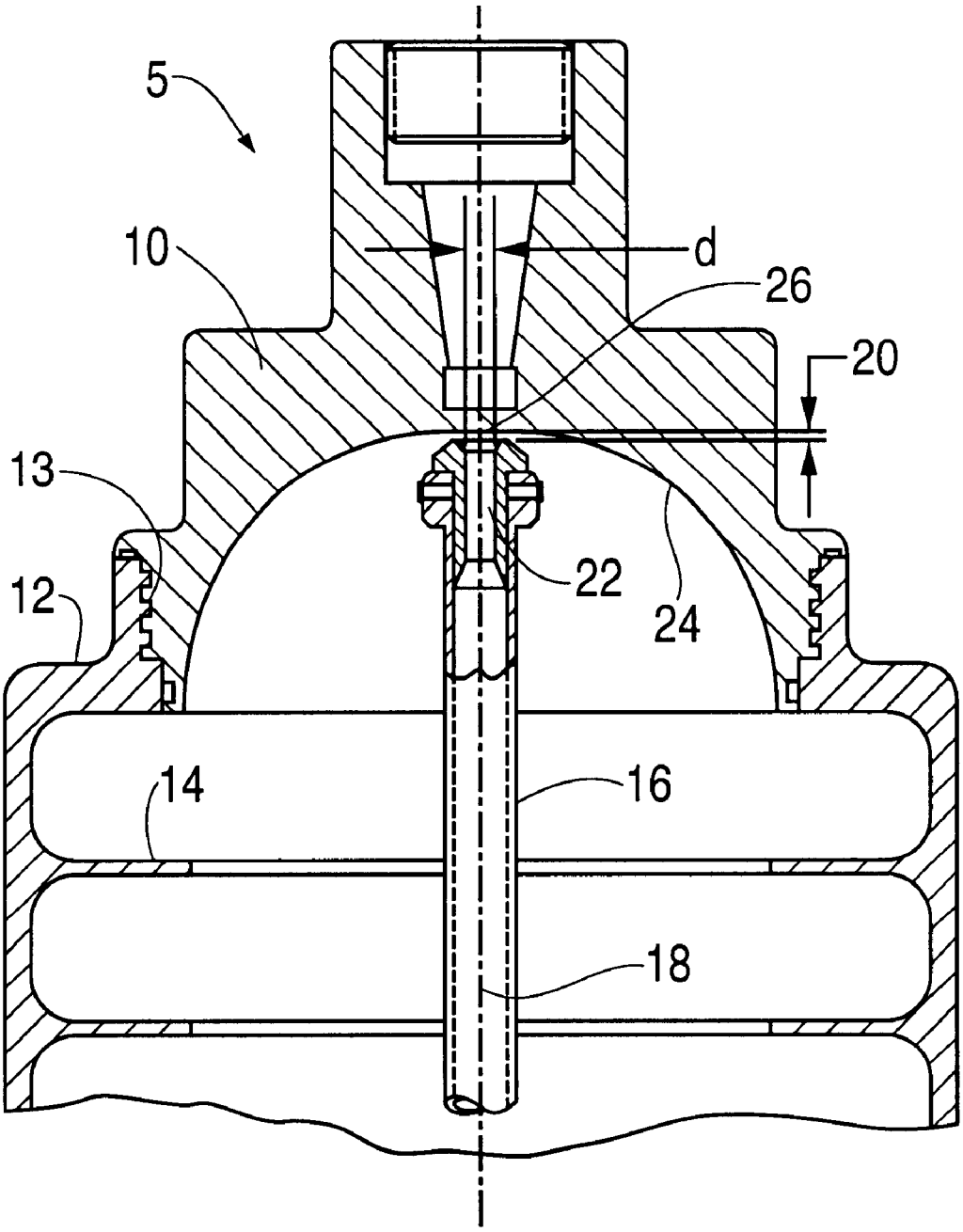
FIG. 1 is a cross-sectional view of a feed applicator and accelerator of a centrifuge separator in accordance with the present invention.

FIG. 1 illustrates a centrifugal separator 5 in accordance with the present invention. Centrifugal separator 5 includes a hemispherical dome-shaped feed accelerator 10 and a centrifuge bowl 12. For clarity and ease of understanding, FIG. 1 shows only a small portion of centrifuge bowl 12.

Feed accelerator 10 is rotatable about an axis of rotation 18, and has an inside surface 24 with a point 26 on axis of rotation 18. Feed accelerator 10 is attached to bowl 12 by a screw arrangement 13. During conventional operation, bowl 12 contains a pool of liquid, and more specifically, a solid-liquid suspension. Bowl 12 has conventional circumferential baffles 14 that dampen axial wave motions of the liquid when bowl 12 is rotating. A feed tube 16 is held in place by a fitting (not shown). Feed tube 16 is preferably centered with respect to axis of rotation 18.

Figure 1A:
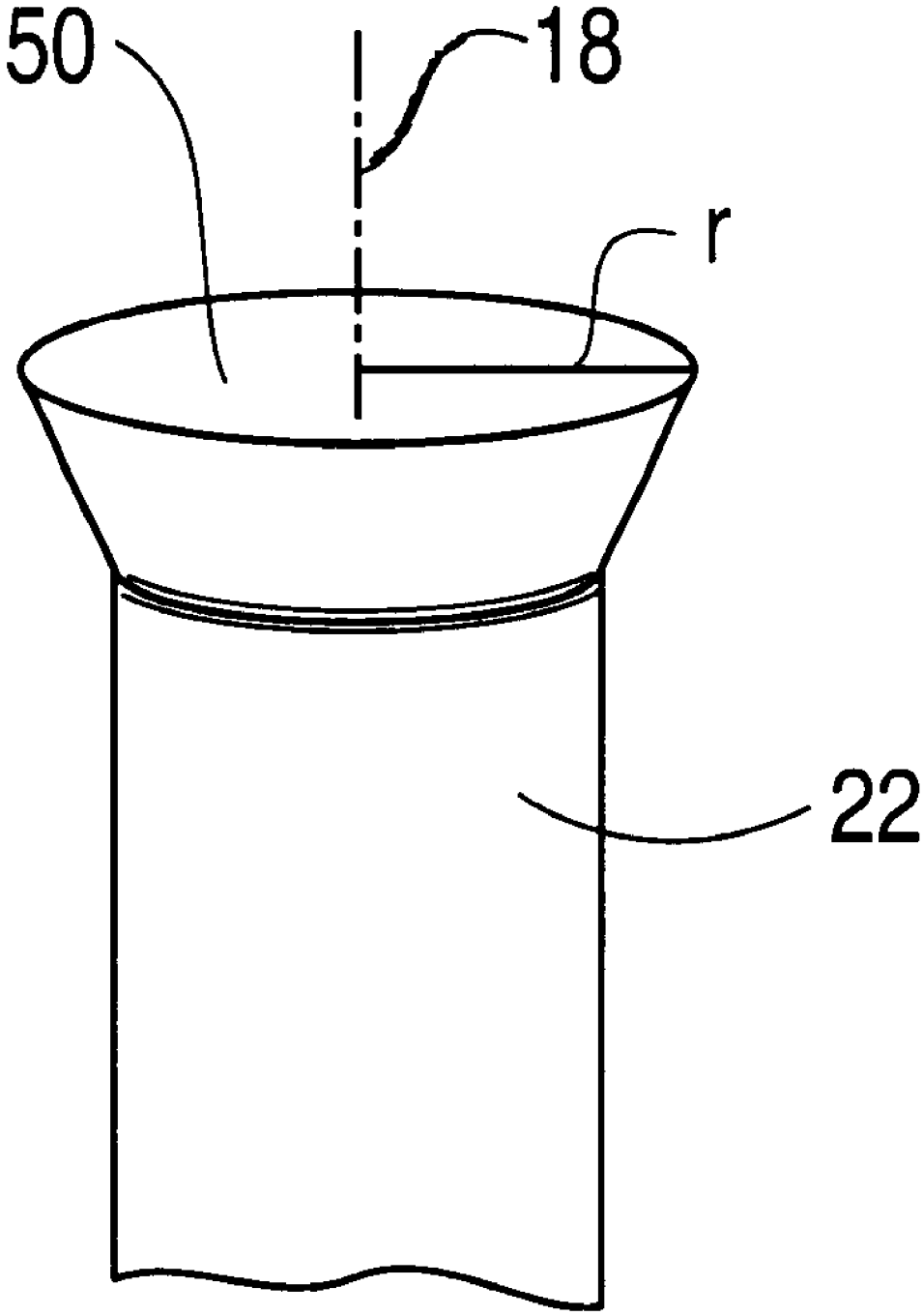
FIG. 1A is a detailed view of a nozzle used in the centrifuge separator of FIG. 1.

A nozzle 22 provides a feed stream in a narrow jet from feed tube 16 via an orifice 50 (see FIG. 1A), which is preferably circular with a radius (r), onto surface 24 at point 26. Orifice 50 is substantially centered about point 26 and is spaced apart from surface 24 by a gap 20.

Figure 1B:
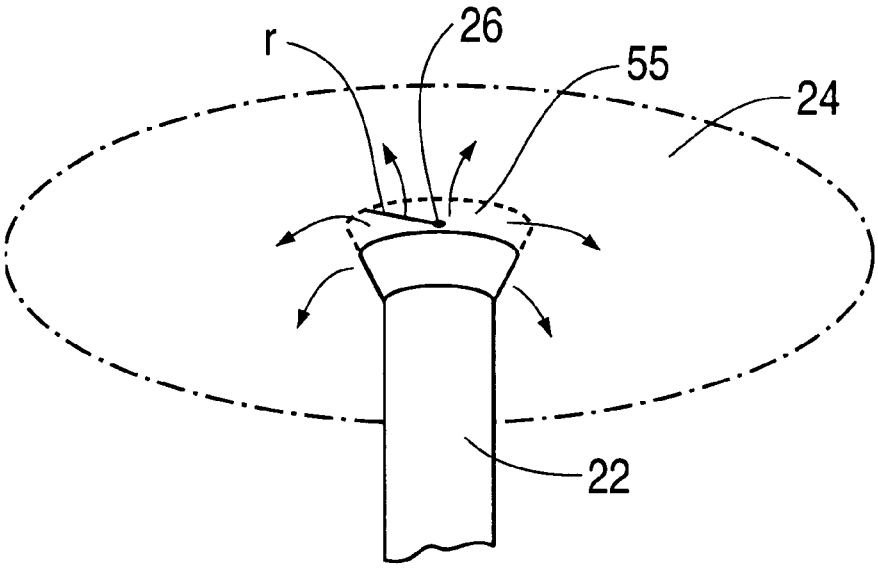
FIG. 1B is a detailed view of a portion of the centrifuge separator of FIG. 1 onto which a feed stream is discharged.
Figure 1C:
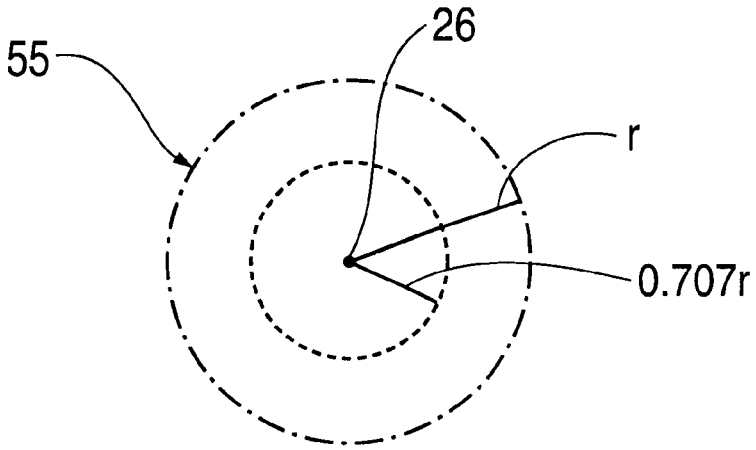
FIG. 1C shows a detailed view of a portion of the centrifuge separator of FIG. 1 for approximating an average tangential velocity.

In operation, for a given flow rate of feed stream flowing via orifice 50, and for a given angular velocity of feed accelerator 10, the diameter of orifice 50 is selected such that an average feed stream velocity in orifice 50 is equal to a tangential velocity of accelerator 10 averaged over an area 55 (see FIG. 1B), which is preferably circular, on surface 24 onto which the feed stream is discharged. In other words, the average velocity, v of the feed stream is approximately equal to an average tangential velocity, $v_t$ of surface 24 in area 55 of surface 24 being centered at point 26 and having radius, r. Thus, area 55 is approximately equal to the area of orifice 50. The tangential velocity of surface 24 averaged over area 55 can be approximated by using the tangential velocity at a point on surface 24 located 0.707 r from point 26, that is, 0.707 of the length of the radius (r) from point 26 (see FIG. 1C).

Nozzle 22 is interchangeable, and thus attachable to, and removable from, feed tube 16. The dimension of gap 20 is set by adjusting the relative position between feed tube 16 and surface 24. For example, assume that the portion of nozzle 22 protruding from the feed tube has a length (L). Gap 20 (g) is set by the steps of (a) substituting, in place of nozzle 22 on feed tube 16, a member, e.g., a solid gauge or a dummy orifice plug (not shown), having a length (m) of approximately m=L+g, (b) adjusting the relative position between feed tube 16 and surface 24 so that the dummy plug contacts surface 24 at point 26; and (c) installing nozzle 22 on feed tube 16 in place of the dummy orifice plug. The dimension of orifice 50 is set by selecting nozzle 22 so that it has a desired orifice dimension, as described below in association with FIG. 3.

For practical reasons it is desirable to minimize the dimension of gap 20. For example, to minimize drips when feed accelerator 10 is operated in a downward-facing orientation (as shown in FIG. 1), or to minimize a hold-up of the feed stream when feed accelerator 10 is operated in an upward-facing orientation (not shown). In the case of ultra shear-sensitive feeds, a minimal dimension for gap 20 should be used as a starting point for empirical studies, and thereafter adjusted to minimize damage to the shear-sensitive cells or particles.

By reducing the width of the feed stream to a narrow jet "d" that impinges on a small target area at the center of the dome of feed accelerator 10, i.e., at point 26, shear rates resulting from the tangential velocity of feed accelerator 10 are reduced to the same order as those resulting from the impingement of the jet of the feed stream from nozzle 22. To minimize shear, it is preferable to center the feed tube 16 with respect to the axis of rotation 18 of bowl 12 as accurately as possible. For this purpose, the accelerator 10 can be provided with a centering target (not shown) etched on its surface. A fitting that holds the feed tube in place allows some lateral adjustment for centering as well as axial adjustment for setting the width of gap 20.

Figure 2:
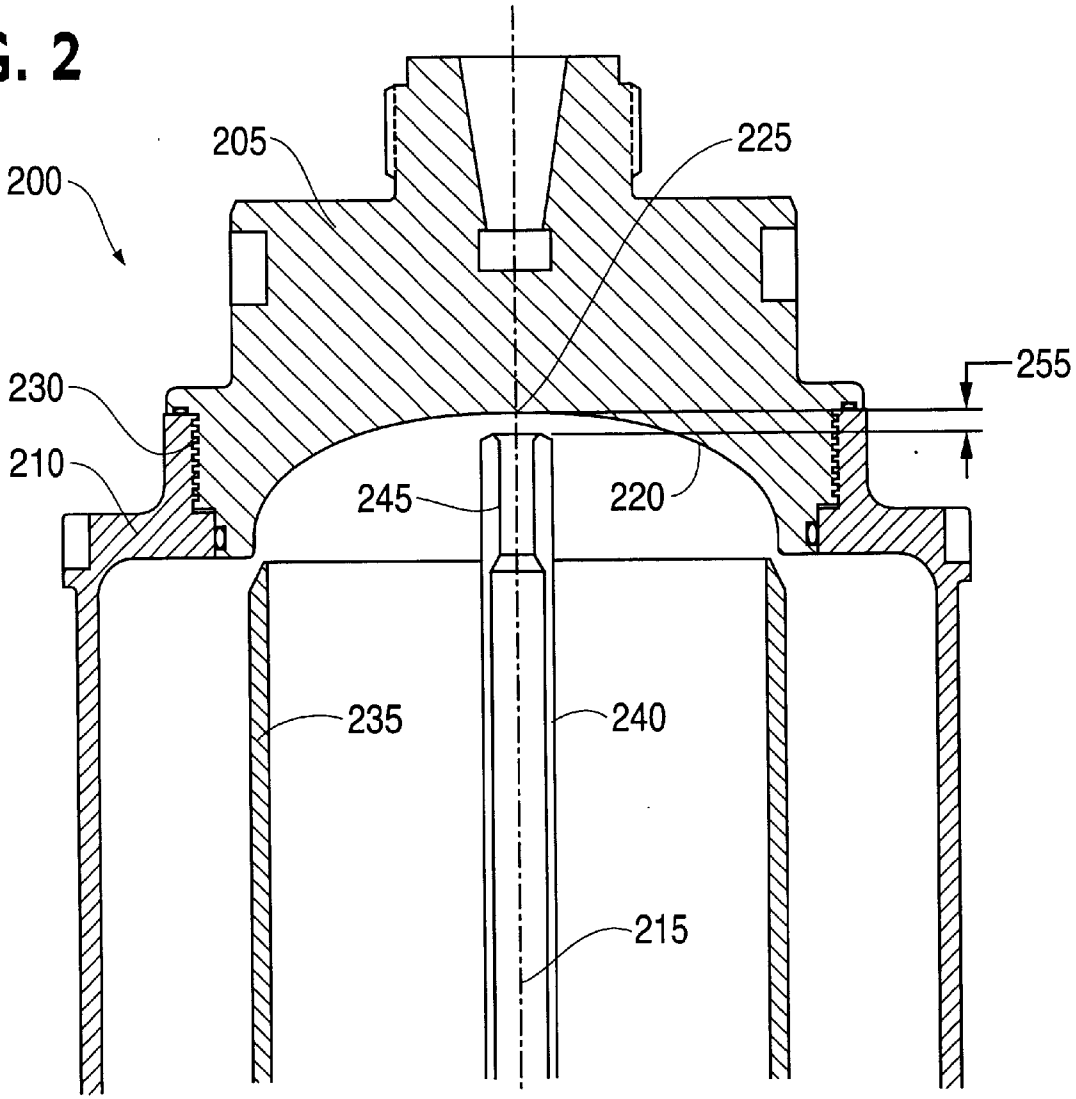
FIG. 2 is a cross-sectional view of a second embodiment of a feed applicator of a centrifuge separator in accordance with the present invention.

FIG. 2 shows another embodiment of the present invention employed in a centrifugal separator 200. Centrifugal separator 200 includes an elliptical dome-shaped feed accelerator 205 and centrifuge bowl 210. FIG. 2 shows only a small portion of centrifuge bowl 210.

Feed accelerator 205 is rotatable about an axis of rotation 215, and has an inside surface 220 with a point 225 on axis of rotation 215. Feed accelerator 205 is attached to bowl 210 by a screw arrangement 230. Bowl 210 has a co-axial baffle 235. A feed tube 240 is preferably centered with respect to axis of rotation 215.

Figure 2A:
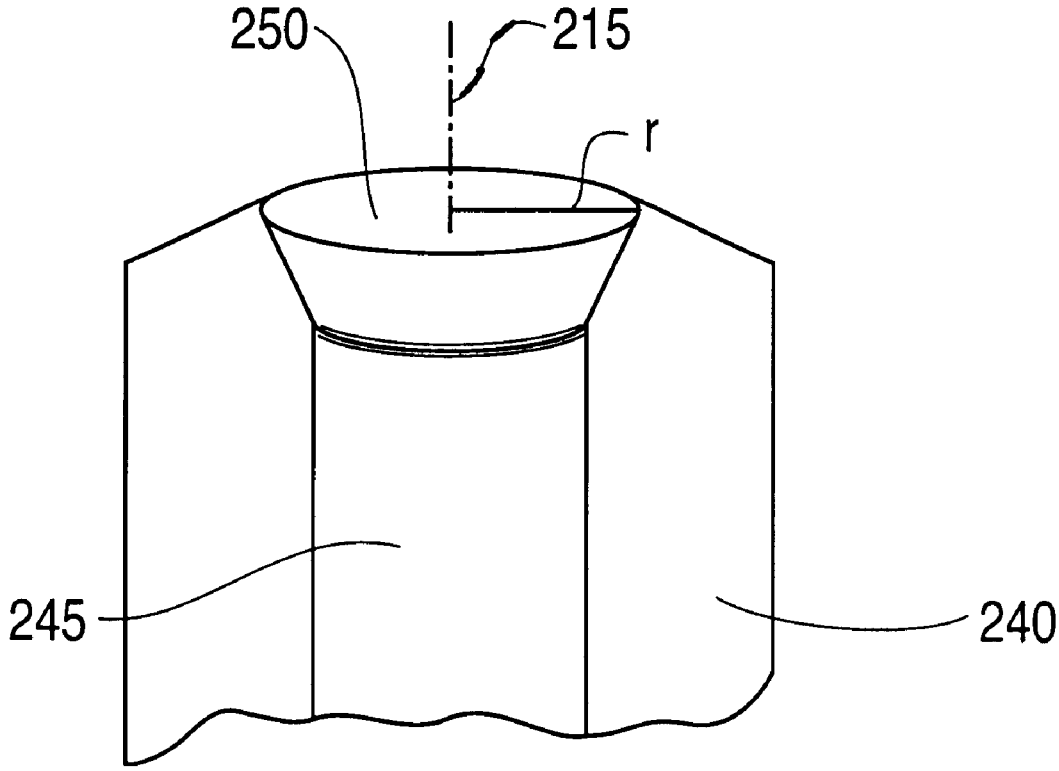
FIG. 2A is an enlarged view of a nozzle used in the centrifuge separator of FIG. 2.

Feed tube 240 includes a nozzle 245 that provides a feed stream in a narrow jet from feed tube 240 via an orifice 250 (see FIG. 2A) onto surface 220 at point 225. The orifice is substantially centered about point 225 and is spaced apart from surface 220 by a gap 255.

Feed tube 240 has superior sanitary properties to that of feed tube 16 shown in FIG. 1. This is because nozzle 245 is an integral part of feed tube 240. Feed tube 240 is interchangeable and available in a variety of different lengths so that gap 255 can be set to a desired width. For the arrangement in FIG. 1, gap 20 is adjusted through the use of a dummy orifice plug. The method of setting gap 225 involves the steps of (a) inserting a gauge between nozzle 245 and surface 220, where the gauge has a width approximately equal to a desired width of gap 255, and (b) adjusting a relative position between nozzle 245 and surface 220, such as by adjusting a position of feed tube 240 in its fitting (not shown). The gauge for setting of gap 255 may be accomplished by installing a mushroom-shaped temporary plug (not shown) into orifice 250 when feed tube 240 is first inserted into centrifuge separator 200. Then, after locking feed tube 240 in its fitting, the temporary plug is removed from feed tube 240. When feed tube 240 and its fitting (not shown) are reinserted, the previously set gap is maintained.

Figure 3:
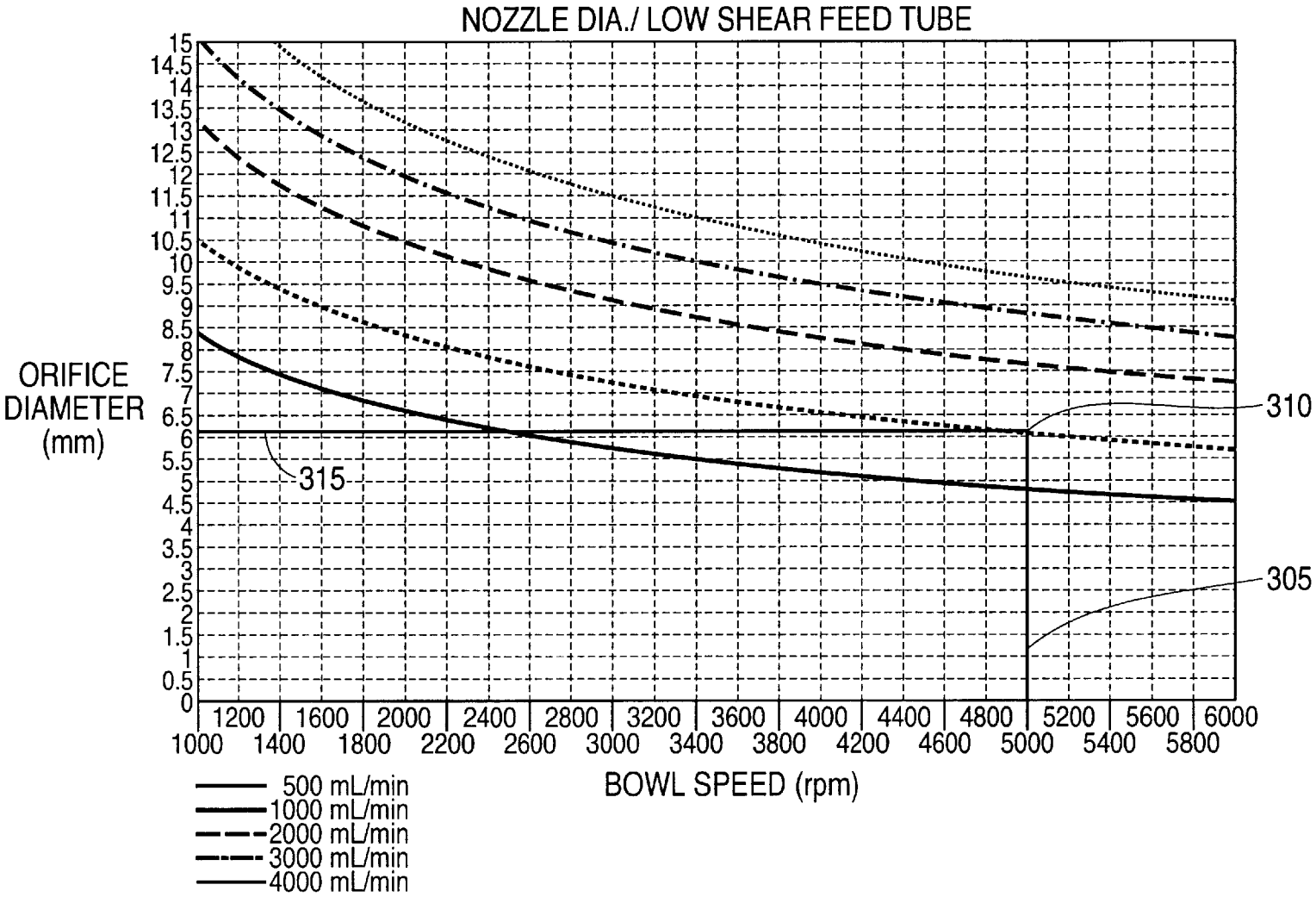
FIG. 3 is a graph for determining an orifice diameter for various combinations of feed flow rate and bowl speed in accordance with the present invention.

FIG. 3 is a graph for determining an orifice diameter for various combinations of feed flow rate and bowl speed in accordance with the present invention. An example is set forth below to illustrate a technique for determining an orifice diameter and gap dimension for given values of bowl speed and feed flow rate.

Assume a feed tube intended for use with a 6 inch diameter centrifuge bowl is equipped with a set of interchangeable nozzle/orifice plugs of 2.0 though 10 mm I.D. To choose the set up that most closely matches velocities for a given set of operating conditions, refer to the graph of FIG. 3 where orifice diameter is related to combinations of feed flow rate and bowl speed at which average fluid velocity through the orifice and area-averaged tangential velocity within the "target" area of the accelerator are matched according to the following equation:

$$\delta=1.414[(4Q/\pi^2\omega)^{1/3}].$$

where

Q=flow rate in ml/min, d=nozzle orifice diameter in cm, and

ω=angular velocity in rpm (revolutions per minute).

Preferably, the orifice diameter, d is set equal to δ, but good results have been achieved over the range of $$\delta/4\leqq d\leqq 2\delta,$$

and, satisfactory results have been found over the range of $$0<d\leqq 4\delta.$$

On the x-axis of FIG. 3, find the desired bowl speed, then select a curve whose parameter most closely matches the feed flow rate. For example, for a bowl speed of 5000 rpm and a flow rate of 1000 mL/min, find 5000 rpm on the x-axis, then draw a vertical line 305 that crosses the 1000 mL/min curve at a point 310 corresponding to 5000 rpm. Then draw a horizontal line 315 from point 310 to the y-axis. The intersection of the horizontal line with the y-axis indicates the nozzle diameter to use. In this example, the indicated diameter is between 6.0 mm and 6.5 mm. Assuming that nozzles are provided in 1.0 mm increments, then the 6.0 mm nozzle would be selected.

As described earlier, the procedure for setting the gap can be facilitated by a solid gauge device that, when substituted for one of the orifice plugs, enables precise depth setting of the feed tube. When any of the orifice plugs are then installed, the gap created between the end of the orifice plug and the surface of the bowl hub can be controlled by the gauge to provide, for example, a relationship g=d/4, where "g" is the gap height and "d" is the inner diameter of the orifice. When this relationship between the orifice inner diameter and the gap height is maintained, the mean feed stream velocity in the orifice is matched by the mean velocity in the annular space immediately adjacent to the orifice.

The gap height d/4 is the preferred minimum value of gap height, but good results have been achieved over the range of $$d/4\leqq g\leqq 4d,$$

and satisfactory results have been achieved over the range of $$0<g\leqq 10d.$$

By selecting the correct orifice diameter for any combination of bowl speed and flow rate, the mean feed stream velocity through the orifice can be closely matched to the surface velocity of the bowl at the point at which the feed stream impinges the feed accelerator. Since the velocity profile of a feed stream has both circumferential, i.e., tangential, and longitudinal components, the above procedure may serve as a starting point, with final operating conditions and gap setting to be determined by trial and error experiments. The range of orifice diameters provided was chosen to provide a good degree of matching over the normal operating range of a centrifuge equipped with a 6 inch diameter bowl.

By applying the feed in the form of a narrow jet, centered at the axis of rotation of the feed accelerator, shear stresses within the liquid phase are minimized. Thus, even the most shear sensitive cells, such as, mammalian cells, can be processed without significant damage from shear forces. This is an important advantage since an increasing number of applications, such as, for example, in the biotech industry, are based on culturing mammalian cells.

It should be understood that various alternatives and modifications can be devised by those skilled in the art. The present invention is intended to embrace all such alternatives, modifications and variances that fall within the scope of the appended claims.

What is claimed is:

1. A centrifugal separator for shear-sensitive solid-liquid separation, comprising:

a centrifuge bowl for containing fluids therein;

an accelerator rotatable at an angular velocity (ω) about an axis, having an inside surface with a point on said axis and and is couple to the centrifuge bowl; and a nozzle for introducing a feed stream at an volumetric flow rate (Q) into said accelerator via an orifice, wherein said orifice is substantially centered about said axis, point, and wherein said orifice has an inner diameter (d) within the range approximately:

$$1\delta\leqq 0<d\leqq 4\delta,$$

where δ=1.414.

2. The centrifugal separator of claim 1, wherein said inner diameter (d) is within the range of approximately:

$$\delta/4\leqq d\leqq 2\delta.$$

3. The centrifugal separator of claim 1, wherein said nozzle is spaced apart from said surface by a gap (g) within the range of approximately:

$$0<g\leqq 10d.$$

4. The centrifugal separator of claim 3, wherein said gap (g) is within the range of approximately:

$$d/4\leqq g\leqq 4d.$$

5. The centrifugal separator of claim 3, further comprising a feed tube onto which said nozzle is attached, wherein said nozzle is removable from said feed tube, wherein said nozzle has a length (L), and wherein said gap (g) is set by the steps of:

(a) substituting, in place of said nozzle on said feed tube, a member having a length (m) of approximately m=L+g;

(b) adjusting a relative position between said feed tube and said inside surface of said accelerator; and (c) installing said nozzle on said feed tube in place of said member.

6. The centrifugal separator of claim 3, wherein said gap (g) is set by the steps of:

(a) inserting a gauge between said nozzle and said surface of said accelerator, wherein said gauge has a width approximately equal to said gap (g); and (b) adjusting a relative position between said nozzle and said inside surface of said accelerator.

7. The centrifugal separator of claim 1, wherein said inside surface has a generally hemispherical shape.

8. The centrifugal separator of claim 1, wherein said inside surface has a generally ellipsoidal shape.

* * * * *

UNITED STATES PATENT AND TRADEMARK OFFICE

CERTIFICATE OF CORRECTION

PATENT NO. : 6,616,590 B2 
DATED : September 9, 2003
INVENTOR(S) : Stephen B. Kessler et al.

It is certified that error appears in the above-identified patent and that said Letters Patent is hereby corrected as shown below:

Column 6,
Lines 37-51, claim 1 should read
A centrifugal separator for shear-sensitive solid-liquid separation, comprising:

a centrifuge bowl for containing fluids therein;

an accelerator rotatable at an angular velocity ($\omega$) about an axis, and having an inside surface with a point on said axis and is coupled to the centrifuge bowl; and a nozzle for introducing a feed stream at a volumetric flow rate (Q) into said accelerator via an orifice, wherein said orifice is substantially centered about said point, and wherein said orifice has an inner diameter (d) within the range of approximately:

$$0 < d \leq 4\delta,$$

where $\delta = 1.414\ [(4Q/\pi^2\ \omega)^{1/3}]$.

Signed and Sealed this

Ninth Day of March, 2004

JON W. DUDAS
*Acting Director of the United States Patent and Trademark Office*